US011725607B2

(12) United States Patent
Frauscher

(10) Patent No.: US 11,725,607 B2
(45) **Date of Patent: *Aug. 15, 2023**

(54) HOT AIR ENGINE HAVING A STEP PISTON

(71) Applicant: Frauscher Holding GmbH, St. Marienkirchen (AT)

(72) Inventor: Josef Frauscher, St. Marienkirchen (AT)

(73) Assignee: Frauscher Holding GmbH, St. Marienkirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 17/553,317

(22) Filed: Dec. 16, 2021

(65) Prior Publication Data

US 2022/0106926 A1 Apr. 7, 2022

Related U.S. Application Data

(63) Continuation of application No. 16/611,414, filed as application No. PCT/EP2018/061441 on May 3, 2018, now Pat. No. 11,215,139.

(30) Foreign Application Priority Data

May 9, 2017 (DE) ..... 102017109967.0

(51) Int. Cl.
*F02G 1/053* (2006.01)
*F02G 1/043* (2006.01)
*F02G 1/044* (2006.01)

(52) U.S. Cl.
CPC ..... *F02G 1/053* (2013.01); *F02G 1/043* (2013.01); *F02G 1/044* (2013.01); *F02G 2243/02* (2013.01); *F02G 2243/04* (2013.01); *F02G 2243/30* (2013.01)

(58) Field of Classification Search
CPC ..... F02G 1/053; F02G 1/043; F02G 1/044; F02G 2243/02; F02G 2243/04; F02G 2243/30; F02G 2270/40
USPC ..... 60/517–526
See application file for complete search history.

(56) References Cited

U.S. PATENT DOCUMENTS

| | | | |
|---|---|---|---|
| 2,567,637 | A | 9/1951 | De et al. |
| 3,074,229 | A | 1/1963 | Bernardus et al. |
| 3,318,089 | A | 5/1967 | Johannes et al. |
| 3,839,858 | A | 10/1974 | Van Avermaete |

(Continued)

FOREIGN PATENT DOCUMENTS

| | | |
|---|---|---|
| DE | 259159 | 4/1913 |
| DE | 8004988 U1 | 7/1980 |

(Continued)

*Primary Examiner* — Hoang M Nguyen
(74) *Attorney, Agent, or Firm* — Murphy, Bilak & Homiller, PLLC

(57) ABSTRACT

According to an embodiment of a hot air engine, the hot air engine includes a transmission with a connecting rod and a double-acting step piston. The double-acting step piston has a first section with a larger diameter and a second section with a smaller diameter, and is arranged in a cylinder. The double-acting step piston is at least partially hollow and the connecting rod extends through the second section and is articulatedly connected in the first section of the double-acting step piston. The double-acting step piston has sealing rings both in the first section and in the second section.

11 Claims, 14 Drawing Sheets

(56) References Cited

U.S. PATENT DOCUMENTS

| | | | | |
|---|---|---|---|---|
| 3,940,934 | A | 3/1976 | Hakansson | |
| 4,044,558 | A | 8/1977 | Benson | |
| 4,069,671 | A | 1/1978 | Berntell | |
| 4,107,925 | A | 8/1978 | Watson | |
| 4,183,219 | A | 1/1980 | Vargas | |
| 4,195,482 | A | 4/1980 | Moloney | |
| 4,195,554 | A | 4/1980 | Rosenqvist | |
| 4,563,131 | A * | 1/1986 | Bookout | F04C 18/3445<br>417/462 |
| 5,103,643 | A | 4/1992 | Ross | |
| 5,345,765 | A | 9/1994 | Kinnersly | |
| 6,112,606 | A | 9/2000 | Shin | |
| 6,324,933 | B1 * | 12/2001 | Waskiewicz | B23Q 1/623<br>318/632 |
| 11,215,139 | B2 * | 1/2022 | Frauscher | F02G 1/053 |

FOREIGN PATENT DOCUMENTS

| | | | |
|---|---|---|---|
| DE | 19904269 | A1 | 11/2000 |
| DE | 10229442 | A1 | 1/2004 |
| GB | 1313393 | A | 4/1973 |
| GB | 1315889 | A | 5/1973 |
| GB | 2174457 | A | 11/1986 |
| GB | 2243192 | A | 10/1991 |
| GB | 2554458 | A | 4/2018 |
| WO | 2009082997 | A2 | 7/2009 |
| WO | 2010093666 | A2 | 8/2010 |

* cited by examiner

HOT AIR ENGINE HAVING A STEP PISTON

TECHNICAL FIELD

The present disclosure relates to a hot air engine that has at least one double-acting displacer or working piston, for example, a Stirling engine.

BACKGROUND

Stirling engines are probably the best known type of hot air engines. When air is used as the working gas, the term "hot air engine" is also commonly used. Some of these engines can be operated both as a motor with external combustion, as well as heat pumps or cooling engines. Other known types of hot air engines include, e.g. Manson engines, Ericsson engines, etc. These days, the name "Stirling engine" is used as a general term to designate various kinds of hot air engines that have a closed gas circulation (i.e. the working gas circulates exclusively within the engine without contact to the surrounding atmosphere). There are three main types of Stirling engines, frequently designated as Alpha type, Beta type and Gamma type Stirling engines, and different variations of each type also exist which are known under special names (e.g. Rider engines, Siemens engines, etc.). Furthermore, among the Alpha types a distinction is made between single-acting and double-acting engines. There are a large number of specific known construction designs for all of these types. Each of the various types and constructions designs of Stirling engines has its own advantages and disadvantages. The inventor of the present application has set himself the objective of creating an improved hot air engine that avoids certain disadvantages known to be inherent in Stirling engines with displacer pistons (Beta and Gamma type engines), in engines with double-acting working pistons (double-acting Alpha type engines) and in other types of hot air engines.

SUMMARY

The aforementioned objective may be achieved by the Stirling engine in accordance with the embodiments described herein.

A hot air engine will be described that comprises, in accordance with one embodiment, a transmission (driving mechanism, crank assembly) with a connecting rod and a double-acting step piston arranged in a cylinder. The step piston has a first section of a greater diameter and a second section of a lesser diameter and is at least partially hollow. The connecting rod extends through the inside of the second section of the step piston and is articulatedly connected in the first section of the step piston.

In one general embodiment the hot air engine comprises a transmission with a connecting rod, as well as a double-acting piston (differential piston) arranged in a cylinder. The cylinder and piston are designed to form a ring-shaped cylinder chamber within the cylinder, the piston is at least partially hollow and the connecting rod is articulatedly connected in the interior of the piston, so that the ring-shaped cylinder chamber extends around the connecting rod. The piston can either be a differential piston designed as a step piston or it can be a differential piston fitted on the outer side of a tube that is arranged coaxially to the cylinder and that extends into the cylinder chamber, forming the ring-shaped cylinder chamber beneath the piston.

In accordance with a further embodiment the hot air engine comprises a transmission that has a connecting rod, a cylinder and a tube that is at least partially arranged in the interior of the cylinder. One end of an at least partially hollow differential piston is arranged between the tube and the inner wall of the cylinder, forming a ring-shaped cylinder chamber. The connecting rod extends through the tube and is articulatedly connected in the interior of the differential piston.

In accordance with a further embodiment the hot air engine comprises a transmission that is arranged in a transmission compartment in which an ambient pressure is present. The Stirling engine further comprises a double-acting step piston arranged in a cylinder, and the piston has a first section of a greater diameter and a second section of a lesser diameter. The step piston is at least partially hollow and has a piston rod in its interior that is mechanically coupled to the transmission. The second section of the step piston, which faces in the direction of the transmission, ends in a buffer chamber for the working gas of the Stirling engine and at least one part of a sealing device is arranged in the interior of the step piston, the sealing device sealing a conduit for the piston rod between buffer chamber and transmission compartment.

BRIEF DESCRIPTION OF THE DRAWINGS

Various embodiments will now be described in detail based on the examples illustrated in the figures. The illustrations are not necessarily true to scale and the embodiments are not limited to the illustrated aspects. Instead importance is placed on illustrating the basic principles. With regard to the figures.

DETAILED DESCRIPTION

Figure 1:
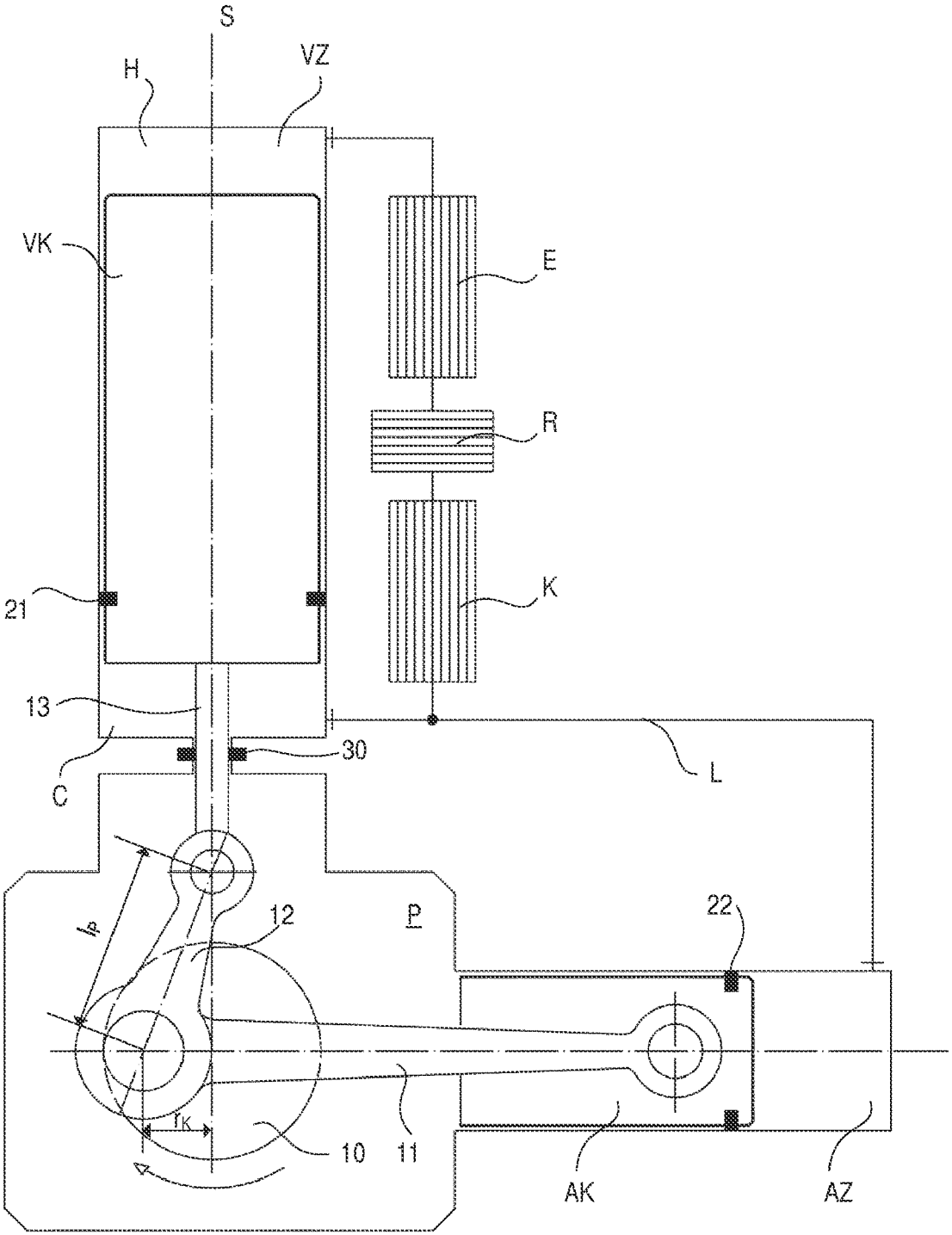
FIG. 1 shows a schematic construction design of a Stirling engine of the Gamma type.

The embodiments described here mainly relate to various types of Stirling engines. The concepts described here (in particular those regarding the basic shape of the pistons and their mechanical coupling to the transmission) are, however, also at least partially applicable to other types of hot air engines. Furthermore, the construction designs of cylinders and pistons described here with reference to the various embodiments can also be combined as desired in multi-cylinder engines. FIG. 1 shows an exemplary construction design of a Stirling machine of the Gamma type. Such a Gamma type Stirling engine functions, for example, as follows; a displacer piston VK in a displacer cylinder VZ, actuated by a crank drive (which has, e.g. a crank shaft 10 and a connecting rod 12), moves the working gas alternatingly back and forth over a heat exchanger (heater E), a regenerator R and a cooler K between a "hot" side H and a "cool" side C of the displacer cylinder VZ. The thus created pressure differences act on a working piston AK (on the right in FIG. 1) which transfers the ensuing force to the crank shaft 10, causing it to carry out a torsional movement. The piston rod 13 of the displacer piston VK extends out of the displacer cylinder VZ through a conduit (sealing 30) and is connected to the crank shaft 10 via a short connecting rod 12. The working piston AK, which lags behind the displacer piston VK, e.g. by an angle of 90 degrees, is connected to the displacer cylinder VZ by a pipe L. Fittings for guiding the small end of the connecting rod for the purpose of absorbing the lateral forces are not shown. Various examples of this are described in the publications WO 2009/082997 A2 and DE 102 29 442 A1.

Figure 2:
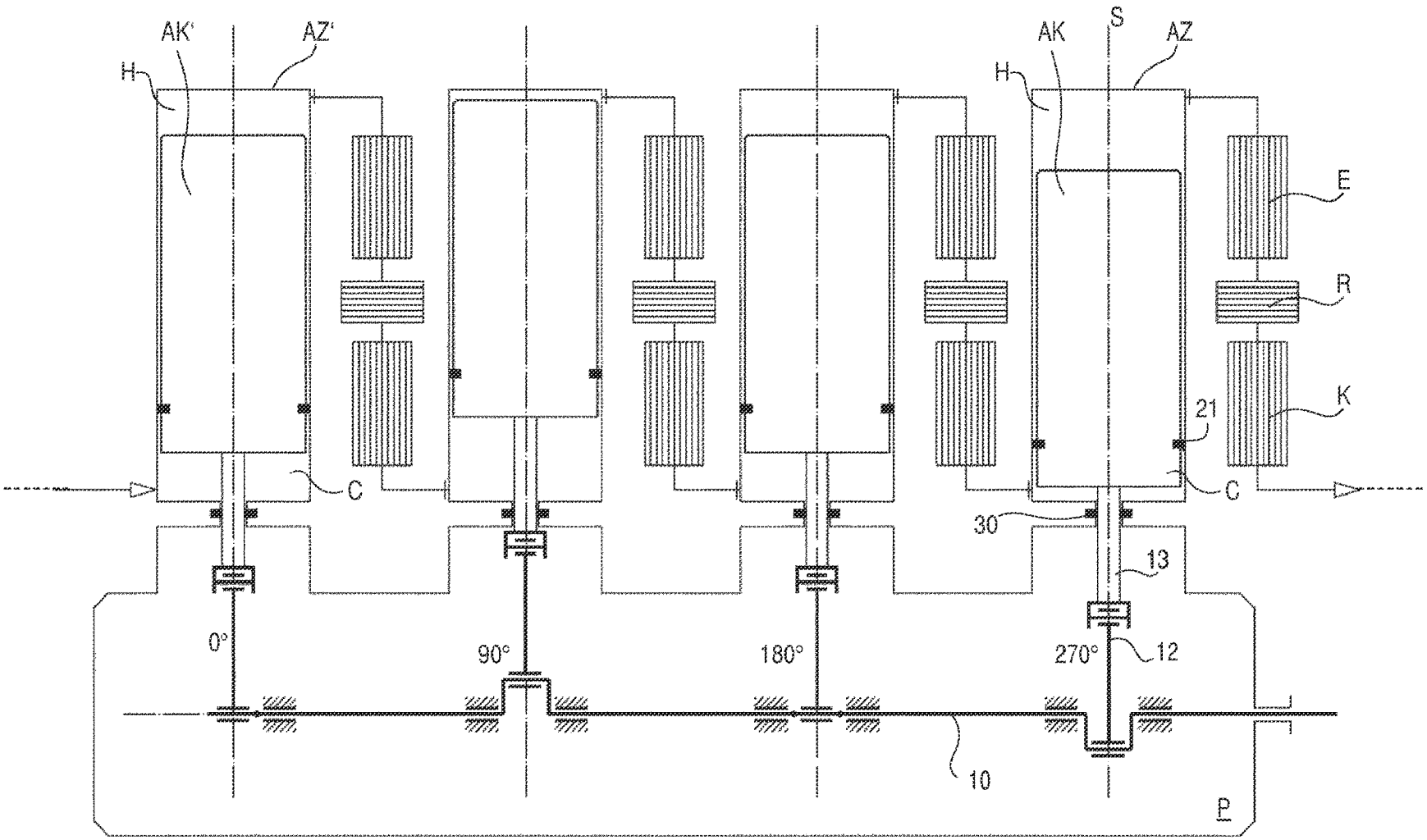
FIG. 2 shows a schematic construction design of a Stirling engine of the double-acting Alpha type.

A construction design similar to that of the displacer piston VK arranged in the displacer cylinder VZ of the Gamma type (see FIG. 1) is used for a double-acting Stirling engine of the Alpha type (also known as the Siemens type) that is exemplarily illustrated in FIG. 2. As opposed to the Gamma type of FIG. 1, however, a double-acting Stirling engine of the Alpha type does not have a separate displacer piston and a displacer cylinder, but instead has numerous working piston—working cylinder units that are connected to each other. In this type—as illustrated in FIG. 2—each hot end H of a working cylinder AZ is connected to the cold end C of the following working cylinder AZ' via heater E, regenerator R and cooler K. Consequently, this type can only be used for engines that have numerous cylinders. Consequently, this type can only be used for machines that have numerous cylinders. As shown in FIG. 2, identically constructed, four piston-cylinder units are often employed, the pistons of which operate in a phase-shifted sequence in phases of 90 degrees (of a complete rotation of the crank shaft). The respective angle position of each working piston is shown in FIG. 2. It is also possible for an engine to have more than four piston-cylinder units. Fittings for guiding the small end of the connecting rod for the purpose of absorbing the lateral forces are not shown. The illustrated double-acting Stirling machine is also sometimes called a Siemens hot gas engine. Various examples of this are disclosed in the publications U.S. Pat. Nos. 3,940,934, 4,069,671 and 4,195,554.

What the two examples of FIGS. 1 and 2 have in common is that the pistons (displacer piston VK in Gamma type, cf. FIG. 1, and the working piston AK in the double-acting Alpha type, cf. FIG. 2) are moved inside of a gas-tight cylinder filled with working gas (displacer cylinder VZ in the Gamma type, working cylinder AZ in the double-acting Alpha type). The piston energy is transferred via a piston rod 13 attached to the piston VK, or respectively, AK. The piston rod 13 in the shown example extends through an opening at the cool end C of the cylinder VZ, or respectively, AK and is sealed (see FIG. 1, sealing 30). The end of the piston rod 13 that extends out of the cylinder can be connected to a connecting rod of a crank drive (e.g. connecting rod 12, crank drive 10), thereby allowing for the oscillating motion. In the embodiments described here, the term "piston rod" designates a rod that is fixedly (not movably) connected to the respective piston such that the piston rod can only move along the longitudinal axis S of the piston. As opposed to this, a connecting rod is connected to be swivelable in relation to the longitudinal axis S of the piston.

In the designs illustrated here, the piston rod 13 absorbs the lateral forces created by the tilt of the connecting rod 12 in region of the conduit leading out of the cylinder VZ (cf. FIG. 1), or respectively, AZ (cf. FIG. 2). These lateral forces can cause problems in the bearing of the piston rod 13. Some designs therefore need to include additional guides—for example, crosshead guides—in order to relieve the stress on the piston rod 13. Similar mechanical elements, however, may increase the design height of the entire arrangement and for this reason relatively short connecting rods 12 are generally employed. This, in turn, creates an unfavorable ratio of the crank radius $r_K$ to the length of the connecting rod $l_P$ (the Lambda value, see FIG. 1), which has an impact that stems from both increased lateral forces, as well as from a high amount of inertia forces of the second order. In addition to this, it may have a negative impact on the thermodynamic process if the movement of the piston deviates significantly from a sinusoidal trajectory.

In a crank drive that is lubricated with oil it may be necessary to take measures with regard to the piston rod 13 to ensure that the oil cannot penetrate into the process chamber or the working gas. Sealing fittings used for this purpose may also increase the design height of the Stirling machine. Here it should be pointed out that, in general, a crank drive is regarded as a mechanical functional unit that is designed to transform an oscillating translational movement of the pistons into a rotation. Thus a crank drive need not necessarily be designed as shown in the examples in accordance with FIG. 1 or 2, in which the connecting rods are articulatedly connected directly to a crank shaft. In an alternative embodiment the crank drive can have a Ross yoke mechanism. In another alternative embodiment a swash plate can be connected to the shaft to transform the oscillating movement of the pistons into a rotation.

Figure 3:
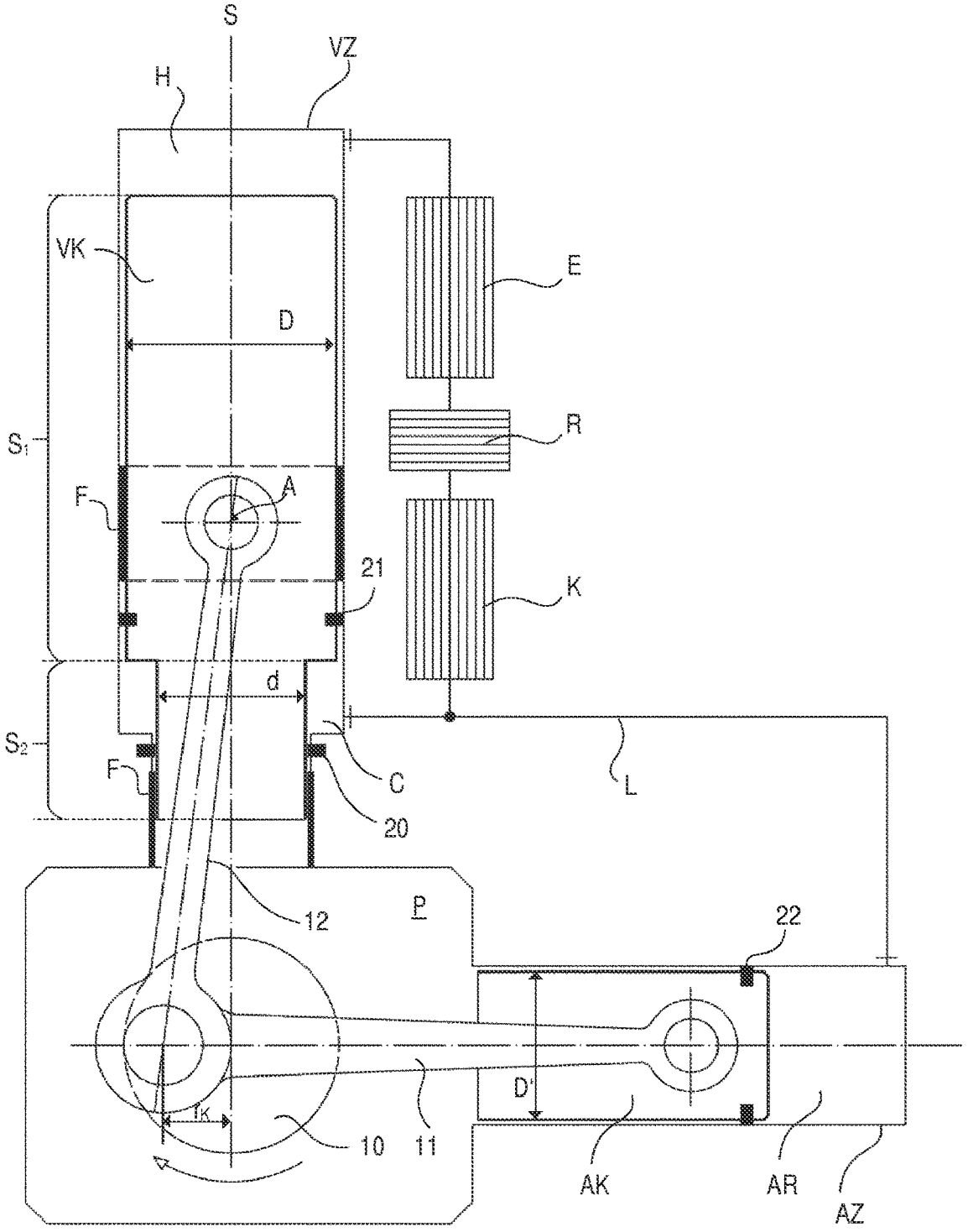
FIG. 3 shows an embodiment of a Stirling engine of the Gamma type with a displacer piston implemented as a step piston.

FIG. 3 shows an example of an improved embodiment of a Stirling machine of the Gamma type. The example illustrated here is essentially the same as the example from FIG. 1, but, instead of the piston rod 13, at its bottom end (that is, at the "cool" side C) the displacer piston VK has a hollow cylinder (tube) with an outer diameter d that is smaller than the outer diameter D of the upper part of the piston VK. In other words, the piston VK is a differential piston implemented as a (double-acting) step piston that has a first section $S_1$ with a larger diameter D and a smaller section $S_2$ with a smaller diameter d.

The displacer piston VK implemented as a step piston is at least partially hollow and the hollow cylinder, which has a diameter d (section $S_2$ of the step piston), can accommodate a conduit for a connecting rod 12 of sufficient length, the upper end of which is articulatedly connected to the step piston VK on the inside of the step piston VK in the region with the largest diameter D (section $S_1$ of the step piston VK). Thus the connecting rod 12 is not connected to the piston VK at its lower end, but instead extends far into the piston VK, up to the section $S_1$. In this manner, a connecting rod 12 that is significantly longer than the one shown in the example of FIG. 1 can be used. The region with the larger diameter D (section $S_1$) is clearly designated in the embodiments illustrated here and lies above the step in the step piston (as seen in an axial direction) at which the diameter widens from the smaller value d to the larger value D. If the transition from the smaller diameter d to the larger diameter D takes place gradually, rather than in one step, the section $S_1$ with the larger diameter is the (axial) cylinder section in which the diameter is larger than the smaller diameter d.

The swivel axis of the connecting rod 12 is designated A. The connecting rod 12 can be articulatedly connected in the piston using various types of bearings. For example, a cylindrical slide bearing or a roller bearing may be used. Alternatively, a spherical joint bearing may also be used which, e.g. can be arranged at the upper end of the connecting rod 12. As previously mentioned, the connecting rod is articulatedly connected in the first section $S_1$ of the step piston (where the diameter of the piston VK is larger than the small diameter d). This means that the swivel axis A of the connecting rod 12 lies in the section $S_1$.

In order to absorb the lateral forces of the piston that run vertically in relation to the middle axis S of the displacer cylinder VZ, it may be useful to provide for a guiding element F (glide surface) in both the region of the large diameter D (section $S_1$), as well as in the region of the small diameter d (section $S_2$). Because of the low ratio of the crank radius to the length of the connecting rod, the piston force in a vertical direction to the middle axis S of the piston is relatively small. Since this force is distributed onto the two guiding elements F, a specific, extremely small surface load arises on the glide surfaces. This arrangement makes it possible to employ oil-free glide elements as guiding elements F, for example, compounds of PTFE graphite that have low friction coefficients. The two guide elements F additionally also ensure a precise linear guidance of the piston VK and prevent tilting movements such as those that can occur when one-piece guiding elements are used or when the guiding elements are arranged very close to each other.

The diameter of the step piston VK can be dimensioned, for example, such that step piston has a smaller diameter d (the outer diameter of the hollow cylinder) that is equal to about 70% of the larger diameter D of the step piston, which corresponds to a ratio between the surface area of the two thus formed circular ring surface area $((D^2-d^2)\times\pi/4)$ an the circular ring surface area defined by the hollow cylinder $(d^2\times\pi/4)$ of around 1:1. Between the second section $S_2$ of the step piston VK and the surface of the cylinder there is a ring volume that, when in operation, is filled with cooled working gas. Accordingly, the region below the step of the step cylinder is the "cool side" C of the step piston VK, or respectively, of the displacer cylinder VZ. The cylinder volume in the displacer cylinder VZ above the step piston VK is filled with hot working gas when in operation. The region above the first section $S_1$ of the step piston VK is therefore the "hot side" H.

A sealing ring 20 is arranged in the second section $S_2$ of the step piston VK. A further sealing ring 21 is arranged in the same manner in the first section $S_1$ of the step piston VK. The sealing ring 21 seals off the hot side H against the cool side C of the displacer cylinder VZ, whereas the sealing ring 20 seals off the cool side C of the displacer cylinder VZ against a buffer chamber that lies below it (cf. also FIG. 4, whereby there the step piston is a working piston of a double-acting Alpha engine and piston rings are used as sealing rings). In the illustrated case of the Gamma engine the hot side H and the cool side C of the displacer cylinder VZ are connected via the heater E, the regenerator R and the cooler K, for which reason essentially the same pressure is found on both sides. The sealing ring 21 thus essentially serves the purpose of preventing process gas from flowing through (leaking) between the step piston VK and the inner wall of the cylinder. As opposed to this, the sealing ring 20 is meant to seal off the inner chamber of the displacer cylinder VZ against the buffer chamber P, which is why the sealing ring 20 is generally implemented as a piston ring. The sealing ring 22 arranged on the working piston AK is likewise intended to seal off the working chamber of the working cylinder AZ against a buffer chamber P located below it, for which reason the sealing ring 22 is likewise generally implemented as a piston ring.

In the embodiments described here it is not important whether the piston guides F and the piston sealing elements 20, 21 (piston rings) are mounted on or in the piston, as elements that move together with the piston, or whether they are arranged on the inside of the piston as fixed, unmovable elements that glide along the piston shaft. In the example of FIG. 3 the piston ring 21 and the guide element F are arranged in the region of the large diameter D of the step piston and the elements consequently glide along the inner wall of the cylinder VZ. As opposed to this, the guide element F and the piston ring 20 are immovably arranged on the inside of the cylinder in the region of the smaller diameter d of the step piston. As the aforementioned assembly variations have no impact on the functioning of the Stirling engine, the variation most suitable for a given design may be chosen. For this reason, this aspect will not be dealt with further in the continued description.

Figure 4:
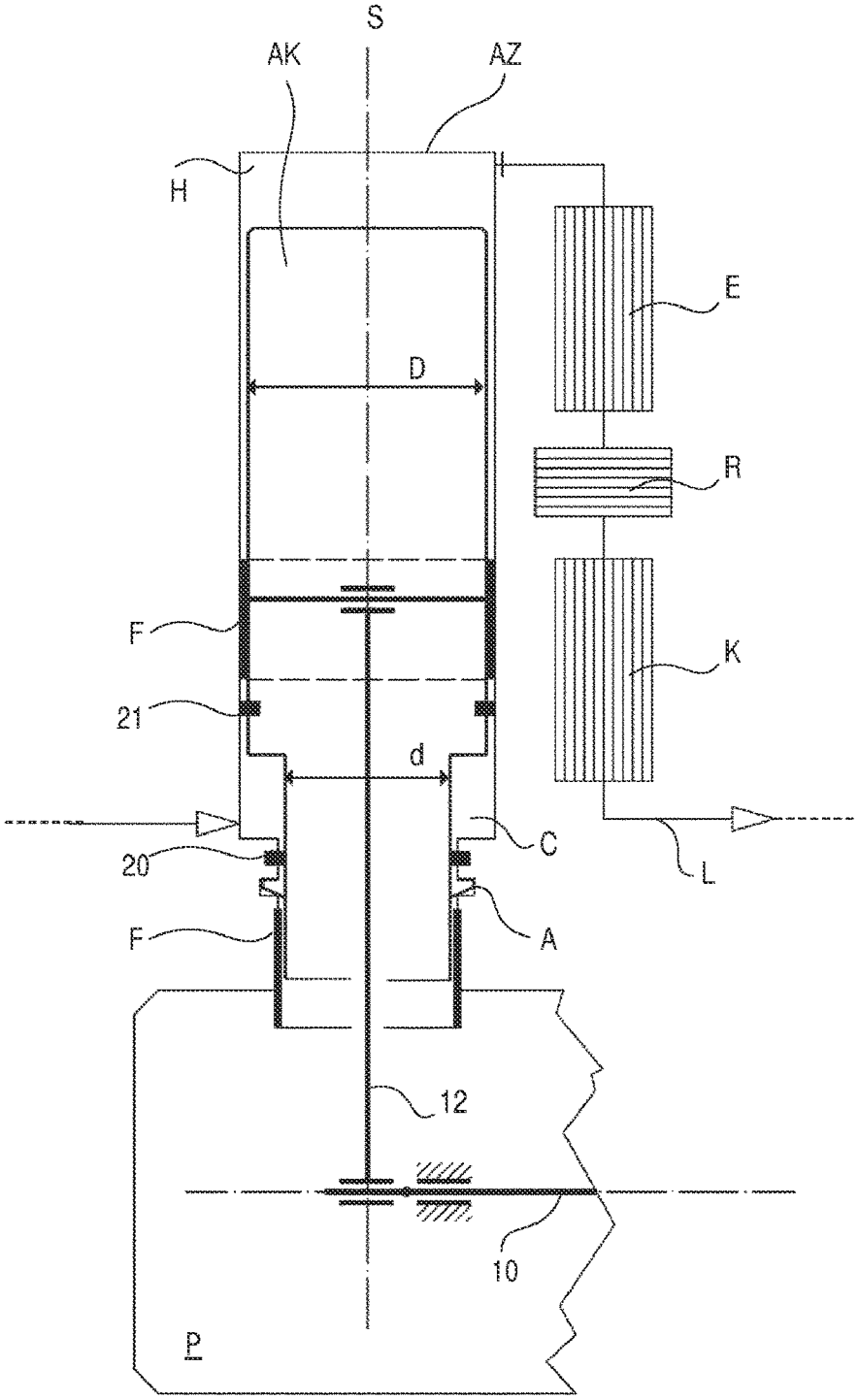
FIG. 4 shows an embodiment of a piston-cylinder unit of a Stirling engine of the double-acting Alpha type with a working piston implemented as a step piston.

FIG. 4 shows an example of an improved embodiment of a piston-cylinder unit of a double-acting Stirling machine of the Alpha type. Numerous such piston-cylinder units (e.g. four, as shown in the example of FIG. 2) can be coupled together to form a double-acting Alpha engine. The example illustrated here is essentially the same as the exemplary piston-cylinder units of FIG. 2, but here, instead of the piston rod 13, the working pistons AK, AK' each have a hollow cylinder (tube) with a diameter d at their lower end, the diameter d being smaller than the diameter D of the upper part of the respective piston AK, AK'. In the present example, the working pistons AK themselves can essentially be designed in the same way as the displacer pistons VK from the previous example of FIG. 3 that are implemented as step pistons and therefore reference is made here to the corresponding description above. The functionalities of the two engine types of FIGS. 3 and 4, however, differ (cf. preceding descriptions of FIGS. 1 and 2). Furthermore, the working pistons AK that are implemented as step pistons here can differ from the displacer pistons VK implemented as step pistons described in the previous example with regard to their sealing elements, for example. The two sealing rings 20 and 21, for example, can both be implemented in the present case as (pressurized) piston rings, as they have to be able to withstand the pressure difference between the hot side H (expansion chamber) and the cool side C (compression chamber) of the working cylinders AZ, AZ'.

If an oil-lubricated crank drive is employed, an oil-scraping element A (oil scraper ring) can be attached around the guiding for the section of the piston with the small diameter (section $S_2$), without significantly lengthening the construction design of the engine. A low Lambda value (rK/lp) will help to ensure an approximately sine-shaped movement of the piston with minimal second-order inertia forces, thereby enhancing the flow of gas through the heater E, the regenerator R and the cooler K. In the illustration of FIG. 4, the working piston AK is approximately at its middle position, which is why the crank shaft 10 exhibits no visible bend.

Figure 5:
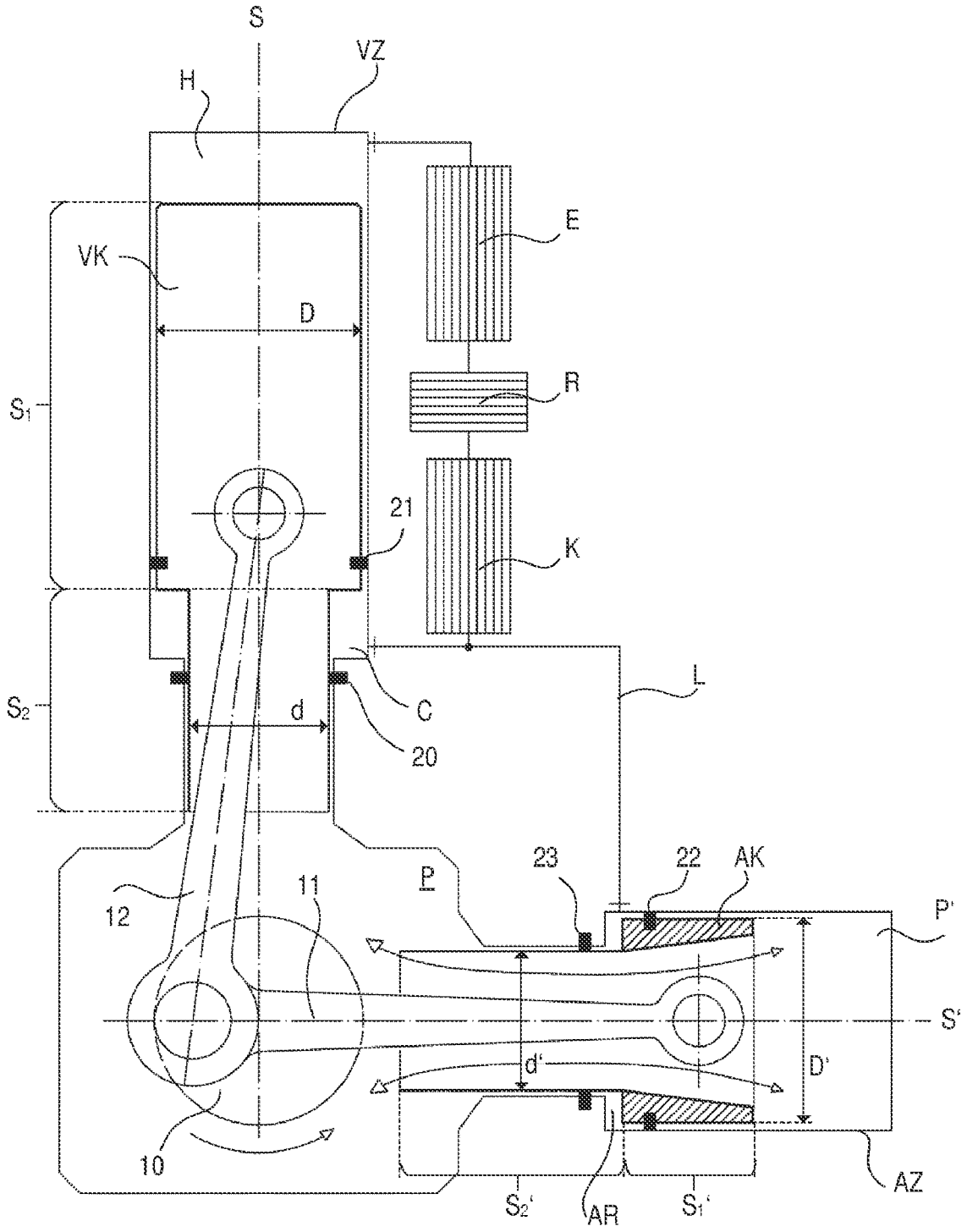
FIG. 5 shows an embodiment of a Stirling engine of the Gamma type, similar to that shown in FIG. 3, wherein the working piston is implemented as a (single-acting) step piston.

FIG. 5 shows a further embodiment of a Stirling engine of the Gamma type that is designed similarly to that of the example shown in FIG. 3. As opposed to FIG. 3, however, here the working piston AK is implemented as a single-acting step piston. The step piston has a first section $S_1$' that has an outer diameter D' and a second section $S_2$' with a smaller outer diameter d'. The working chamber AR of the working cylinder AZ is the ring chamber that is formed between the inner wall of the cylinder and the second section $S_2$'. The connecting pipe L between the cool side C of the displacer cylinder VZ and the working cylinder thus ends in the aforementioned ring chamber (cylinder chamber AR).

The working piston AK has an opening parallel to its longitudinal axis that extends through the piston in order to allow for pressure compensation on the front face of the working piston AK between the buffer chamber P and the cylinder chamber P'. The arrows shown in FIG. 5 that extend through the working piston show that it is possible for gas to flow through it, thus making the aforementioned pressure compensation possible. The connecting rod 12 that is coupled to the working piston AK is—similar to that of the displacer piston AK—articulatedly connected on the inside of the working piston AK in the section $S_1$' that has the larger diameter D'. The sealing ring 23 seals off the cylinder chamber AR (working chamber/ring chamber) of the working cylinder AZ against the buffer chamber P. Likewise, the sealing ring 22 seals off the working chamber AR against the cylinder chamber P' at the front face, in which the same pressure is present as in the buffer chamber P. Both sealing elements 22, 23 can be implemented as piston rings. Reference is made to the description of FIG. 3 with regard to the remaining details (in particular with regard to the displacer cylinder VZ and the crank drive). The variation illustrated in FIG. 5 allows for a shorter pipe L between the displacer cylinder VZ and the working cylinder AZ than that of the example shown in FIG. 3, which reduces the dead space while allowing for a relatively long connecting rod 11.

Figure 6:
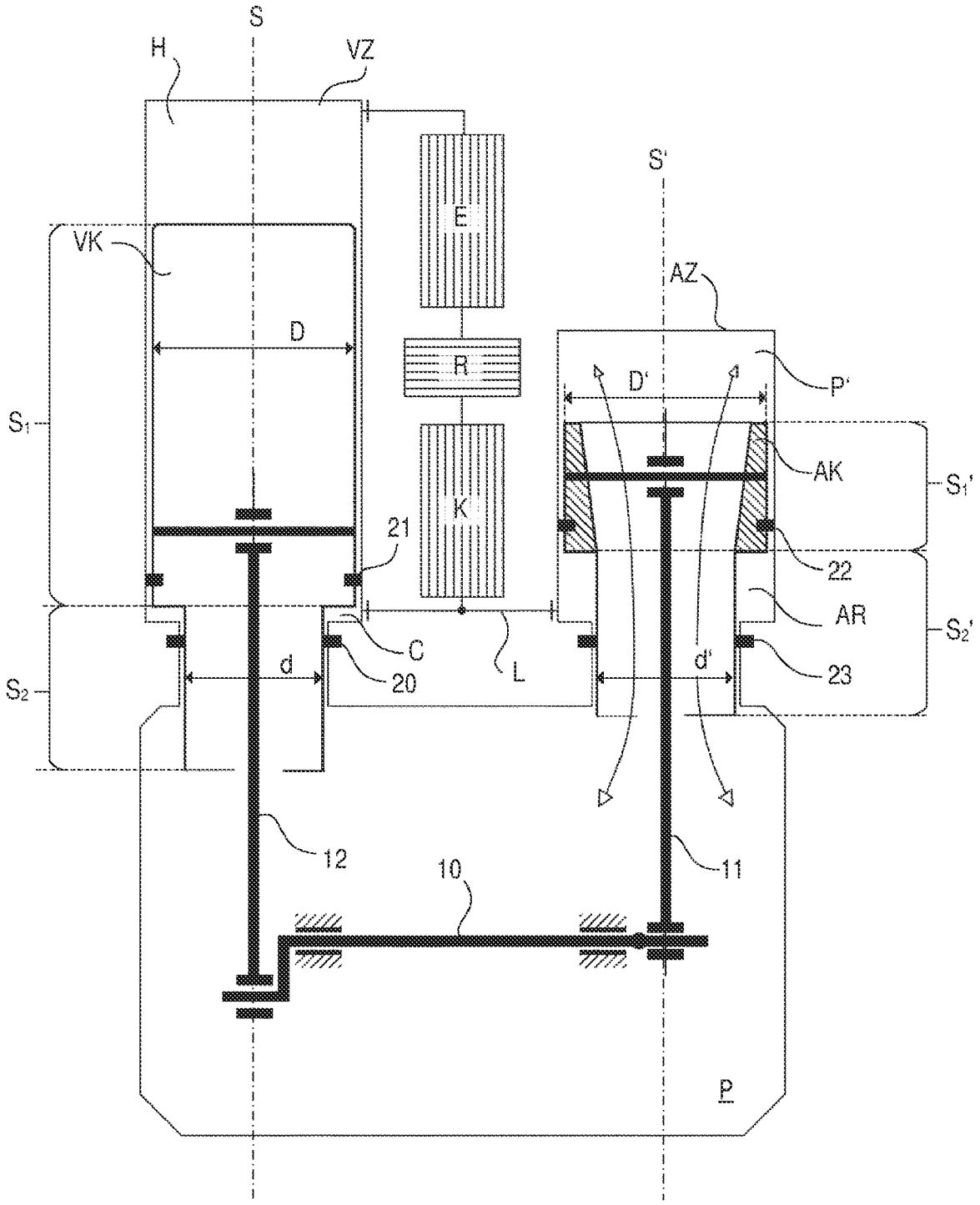
FIG. 6 shows an embodiment of a Stirling engine of the Gamma type that is similar in its functioning to that of the example illustrated in FIG. 5, but which has piston and cylinder arranged in parallel.

FIG. 6 shows a further embodiment of a Stirling engine of the Gamma type that is very similar to the preceding example of FIG. 6 with regard to the functionality and design of the pistons. The main difference between the examples of FIGS. 5 and 6 consists in the position of the cylinders relative to each other. In accordance with FIG. 6 the longitudinal axes S and S' of the displacer cylinder VZ and the working cylinder AZ extend parallel to each other, whereas in the previous example the longitudinal axes S and S' essentially form a right angle, thus creating a V-type engine. This parallel arrangement of the cylinders allows for an even connecting pipe L between the displacer cylinder VZ and the working cylinder AZ than that of the preceding example and thus results in even less dead space. Reference is made to the description of FIGS. 3 and 5 with regard to the remaining details.

Figure 7:
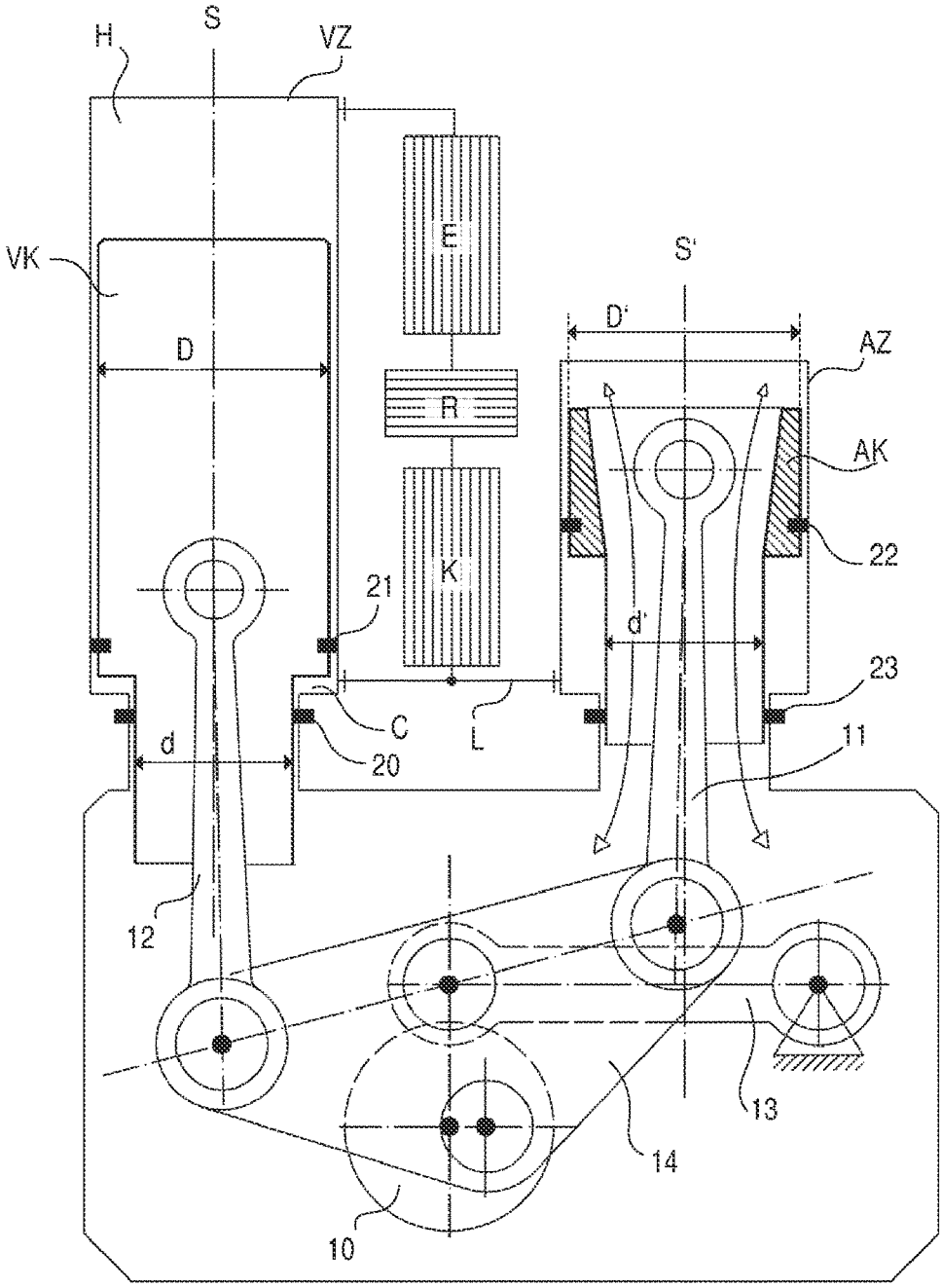
FIG. 7 shows an embodiment of a Stirling engine of the Gamma type that is similar in its functioning to that of the example illustrated in FIG. 6, but which has a so-called Ross yoke mechanism as a crank drive.

FIG. 7 shows a variation of the example of FIG. 6. The main difference between the examples of FIGS. 6 and 7 consists in the crank drive which, in accordance with FIG. 7, comprises a so-called Ross yoke mechanism. When a Ross yoke is employed, the connecting rods 11 and 12 do not directly connect the pistons to the crank shaft 10. Instead, the ends of the connecting rods 11 and 12 that are distant to the pistons are articulatedly connected to a rocker (yoke) 14 that transmits the oscillating movement of the pistons to the crank shaft 10. The yoke 14 is additionally connected via a further connecting rod 13 to the transmission housing. Such Ross yoke mechanisms are commonly known and will therefore not be described here in further detail. With the exception of the crank drive, the example of FIG. 7 is essentially designed just like that of the example shown in FIG. 6 and further reference is made to the corresponding description above.

Figure 8:
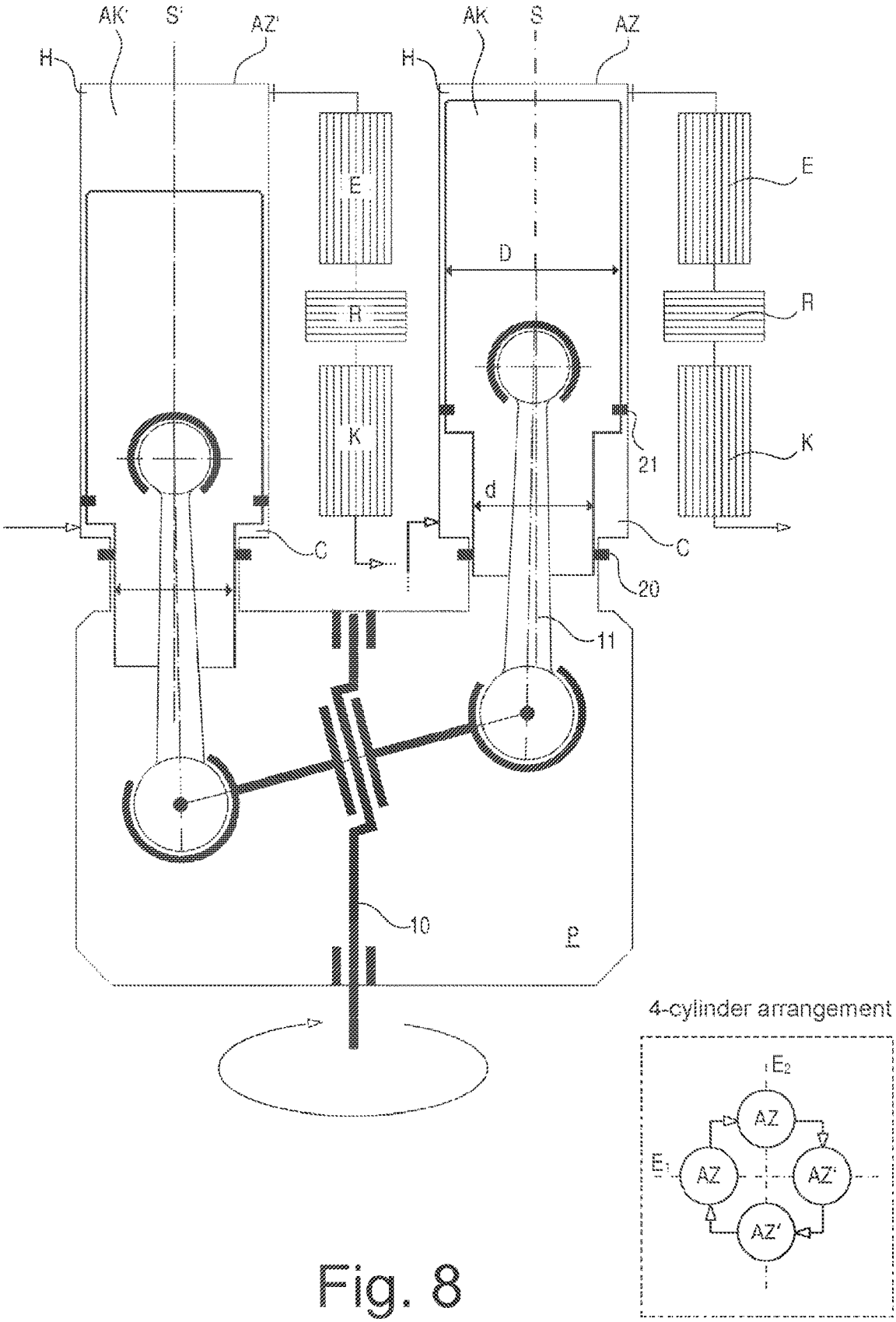
FIG. 8 shows an embodiment of a piston-cylinder unit of a Stirling engine of the double-acting Alpha type with a working piston implemented as a step piston that is coupled to a shaft via a swash plate mechanism.

FIG. 8 shows a variation of the example of FIG. 4. Here four or more cylinder units (working cylinder AZ/working cylinder AZ') drive a crank shaft 10 via a swash plate mechanism. In the sectional view shown in FIG. 8 two cylinder units that are arranged on opposite sides (of the transmission) are illustrated. In this case the "crank" of the shaft 10 is formed by the inclined swash plate to which the connecting rods 11 and 12 are articulatedly connected (e.g. by means of spherical bearings). Swash plate mechanisms are commonly known and will therefore not be described here in greater detail.

Similar to the example of FIG. 2, here at least four cylinder units are needed to form a double-acting Stirling engine of the Alpha type. The box in the lower right hand corner of FIG. 8 shows a schematic top view that illustrates how such an engine can be designed. Two cylinders AZ and AZ' are arranged on each of the levels $E_1$ and $E_2$, wherein the longitudinal axes of the cylinders lie on the levels $E_1$ and $E_2$ that extend horizontally relative to each other (which need not necessarily be the case). One cylinder AZ on the first level $E_1$ is connected (via the heater E, regenerator R and cooler K) to a corresponding cylinder AZ on the second level $E_2$. This cylinder is in turn connected to the second cylinder AZ' on the first level, etc. In this manner a four-cylinder engine is formed. As mentioned previously, however, designs having more than four cylinders are also possible.

Figure 9:
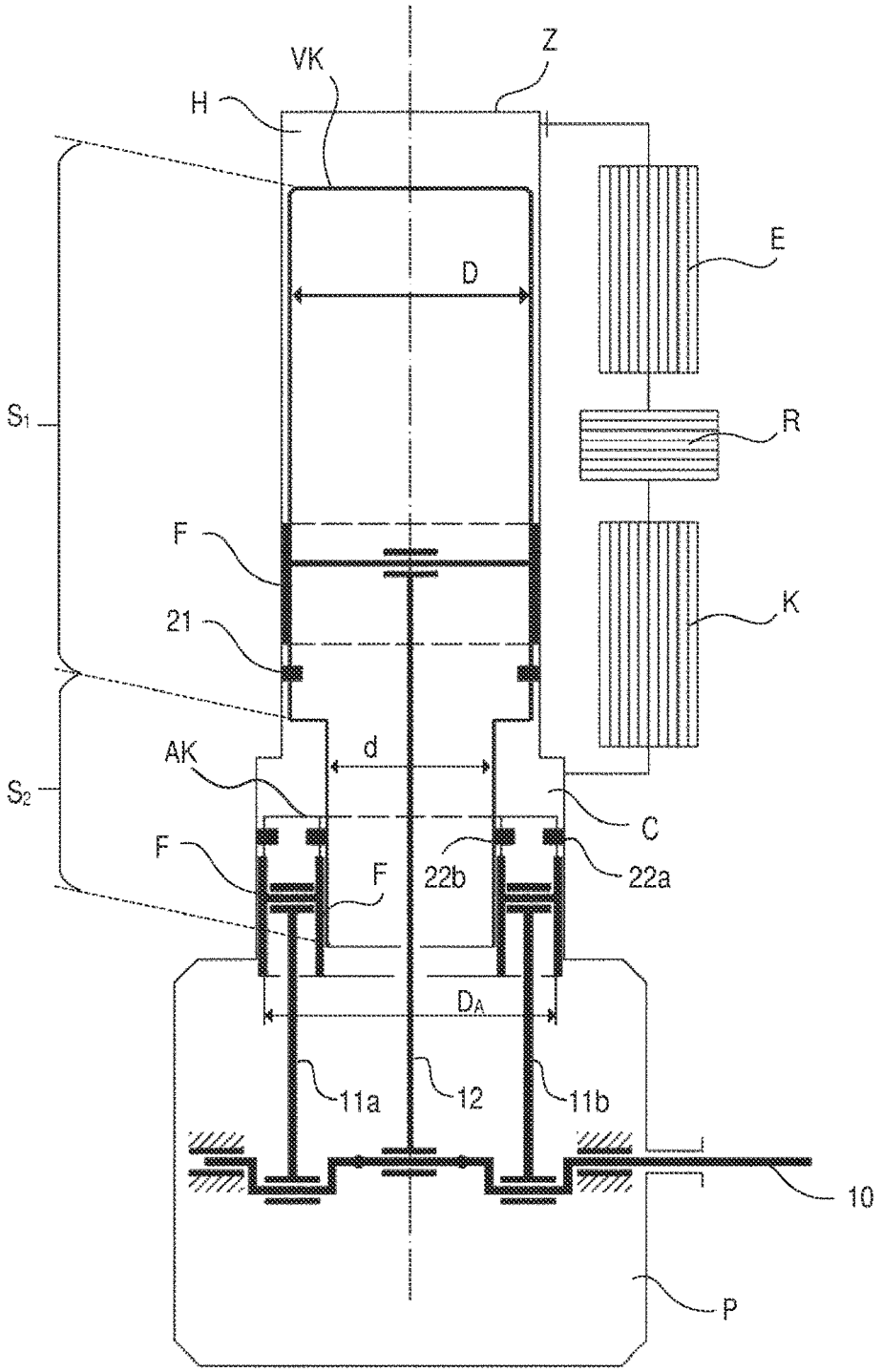
FIG. 9 shows an embodiment of a Stirling engine of the Beta type with a displacer piston implemented as a step piston.

A step piston such as the one described above in reference to Stirling engines of the Gamma type and of the (double-acting) Alpha type can also be employed in a Stirling engine of the Beta type. An example of a Beta type engine is illustrated in FIG. 9. Similar to a Gamma engine (cf. FIG. 3), a Beta engine has a displacer piston VK and a working piston AK. However, as opposed to the example of FIG. 3, the displacer piston VK and the working piston AK move within the same cylinder Z. As in a Gamma engine, the displacer piston VK is implemented as a step piston (cf. FIG.

3), whereas the connecting rod 12 that connects the step piston VK to the crank shaft 10 extends through the second section $S_2$ of the (at least partially hollow) step piston VK and is articulatedly connected in the first section $S_1$ of the step piston VK. The design of the displacer piston VK illustrated here makes it possible to employ a comparatively long connecting rod 12, which improves the Lambda value. A guide element F (glide surfaces) can be provided in the region of the large diameter D (section S1) of the step piston VK to absorb the lateral piston forces exerted vertically to the middle axis S of the cylinder Z. With regard to the other details of the displacer piston VK implemented as a step piston reference is made to the corresponding description of FIG. 3.

The working piston AK is implemented as a ring-shaped piston (ring piston) and moves coaxially to the displacer piston VK. The outer diameter of the ring piston AK is designated DA and the inner diameter of the ring piston (with the exception of the piston clearance) corresponds to the small diameter d of the step piston VK. The section $S_2$, that with the smaller diameter d, of the step piston VK extends through the ring piston AK. The sealing rings (piston rings) can be arranged on the ring piston AK, one to seal it off towards the outside (sealing element 22*a*) and another to seal it off towards the inside (sealing element 22*b*). The guiding glide surfaces F can likewise be arranged on (the inside and the outside of) the ring piston AK. Other arrangements for this are also possible, e.g. arranging the piston ring 22*b* on the step piston VK in section $S_2$ or arranging the guiding glide surfaces F on the cylinder Z.

As illustrated in FIG. 9, the working piston AK that is implemented as a ring piston is coupled to the crank shaft 10 via two connecting rods 11*a*, 11*b* arranged symmetrically to the middle axis S. The cylinder Z is step-shaped in order to create more space for connecting the upper end of the connecting rods 11*a*, 11*b*, allowing for an outer diameter DA of the ring piston AK that is larger than the outer diameter D of the section $S_1$ of the step piston VK. The additional piston surface area gained by enlarging the outer diameter DA (ring surface area $(DA^2-d^2)\times\pi/4$) can be used to correspondingly reduce the stroke length of the working piston. This makes it possible to obtain a Lambda value for the connecting rods 11*a*, 11*b*, which, by necessity, are shorter than the connecting rod 12, that is similarly favorable to that of the connecting rod 12 of the displacer piston VK. The piston surface areas (ring surface areas) of step pistons (displacer pistons VK) and ring pistons (working pistons AK) and the corresponding length of the piston strokes can be chosen such that the relative proportions of the stroke volumes is approximately 1:1. In the illustration shown in FIG. 6 the displacer piston VK is positioned at approximately half stroke, which is why the crank shaft 10 does not exhibit a bend. As in the case of Gamma engines, the displacer piston VK leads the working piston AK in a phase of around 90 degrees (with regard to the angle position of the crank shaft 10). The crank shaft 10 is arranged in the buffer chamber, as in the example in accordance with FIG. 3.

Figure 10:
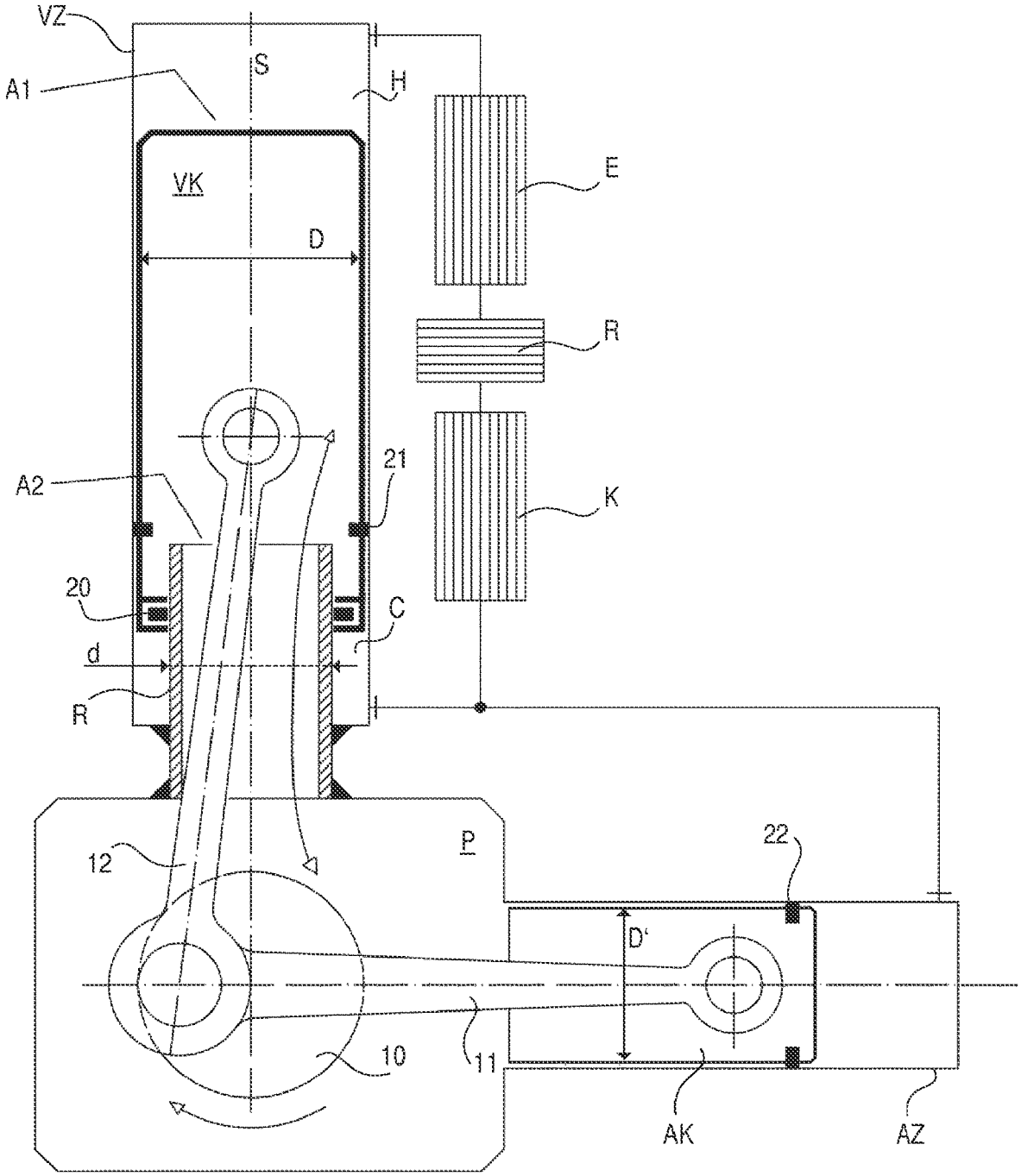
FIG. 10 shows an embodiment that is essentially equivalent in its functioning and kinematics to that of the example illustrated in FIG. 5, wherein however, instead of a step piston, an at least partially hollow differential piston is used as displacer piston, the differential piston being arranged between a tube that extends into the cylinder and the inner wall of the cylinder.

FIG. 10 shows a variation of the embodiment of FIG. 3. The examples of FIGS. 3 and 10 are equivalent in their functionality and kinematics. The two examples only differ from each other in their construction designs of the displacer cylinder VZ and of the displacer piston VK arranged inside of it, whereas the piston strokes and the cylinder volumes of both variations may be the same. In accordance with FIG. 10, a differential piston of a somewhat different design is employed instead of a step piston. In the present example, the differential piston is arranged coaxially to a tube R that extends into the inner chamber of the displacer cylinder VZ (and into the differential piston). The differential piston is (at least partially) hollow and is arranged between the tube R and the inner wall of the cylinder such that a ring-shaped cylinder chamber (ring chamber) is formed below the differential piston between the outer surface of the tube R and the inner surface of the cylinder, as would also be the case if a step piston were employed. The guide element, which is not show in FIG. 10, can be arranged on the outside of the differential piston or on the inner wall of the cylinder. The tube R is fixedly attached to the engine housing (e.g. screwed on) and the sealing element 20 seals the ring chamber (i.e. the cool side C of the displacer cylinder VZ) off against the inside of the differential piston, in which the same pressure is present as in the buffer chamber P. The arrows shown in FIG. 10 that lead through the tube again indicate the gas flow and the possibility of equalizing the pressure (analogously to FIG. 5). The sealing element 21 only needs to prevent leakage, as explained above with reference to FIG. 3. The connecting rod 12 extends through the tube R and is articulatedly connected on the inside of the differential piston VK. This makes it possible to achieve the same favorable ratio of the crank radius $r_K$ to the length of the connecting rod $l_P$ (Lambda value, see FIG. 1) as that achieved in the example of FIG. 3. Reference is made to the description of FIG. 3 regarding the remaining details.

Figure 11:
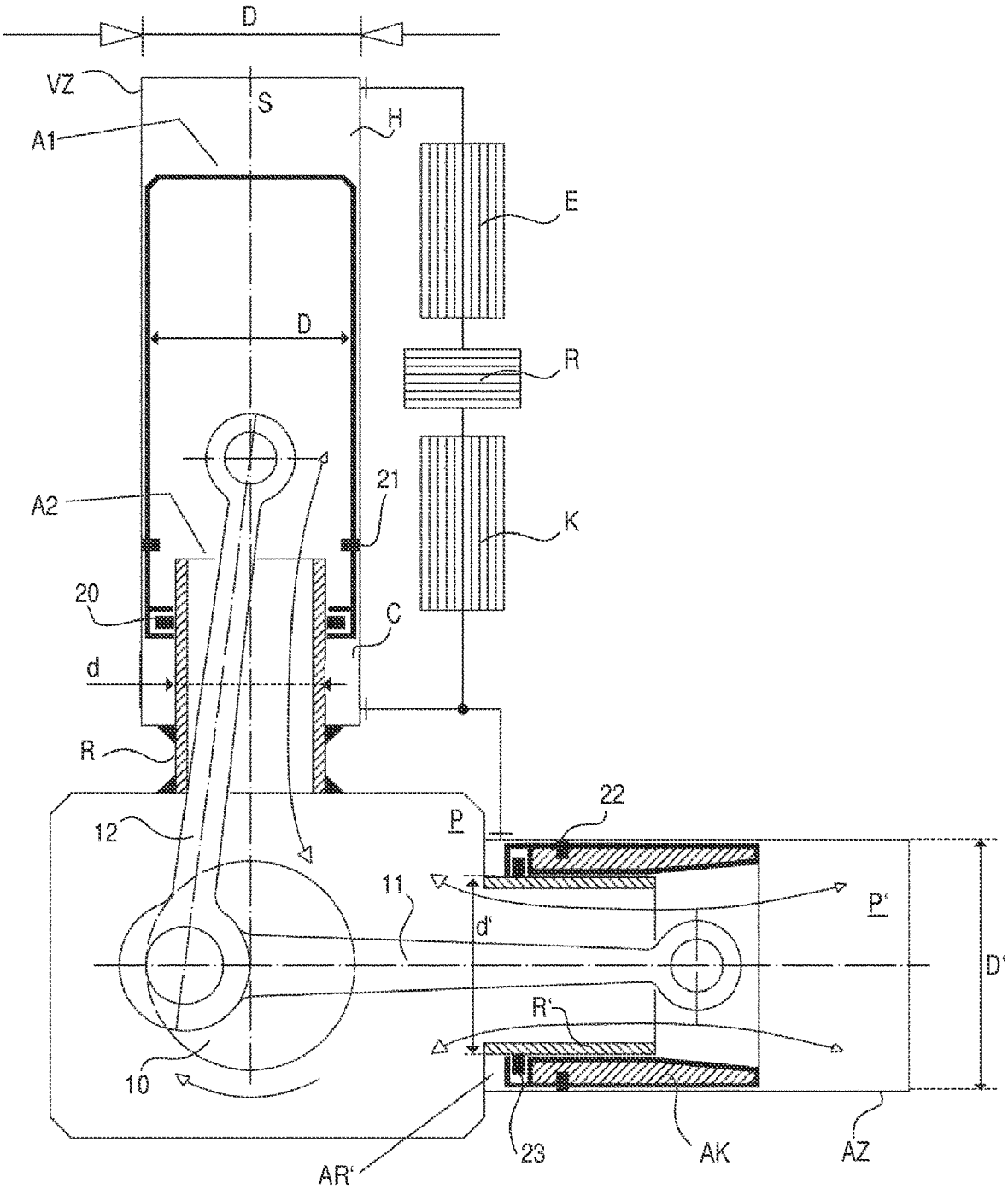
FIG. 11 shows an embodiment that is essentially equivalent in its functioning and kinematics to that of the example illustrated in FIG. 5, wherein, instead of a step piston, an at least partially hollow differential piston is used as displacer piston and an annular piston is used as working piston and wherein both the differential piston and the annular piston are each arranged between a tube that extends into the cylinder and the inner wall of the cylinder.

The example of FIG. 11 is a modification of the example of FIG. 5. Both examples are equivalent in their functionality and kinematics. In accordance with FIG. 11, the displacer cylinder VZ and the displacer piston VK are designed the same as in the preceding example of FIG. 10. This structure replaces the step piston of FIG. 5. In accordance with FIG. 11, the working piston AK is implemented as a ring piston that is also arranged around a tube R' extending into the working piston and that is sealed off against the outer surface of the tube R' (see, e.g. piston ring 23). The tube R' is—analogously to the tube R of the displacer cylinder VZ—fixedly attached to the housing of the engine and extends, as mentioned, into the working cylinder AZ. As in FIG. 5, the working piston AK is hollow and allows for pressure compensation between the buffer chamber P and the cylinder chamber P' at the front face of the working piston AK. The sealing ring 22 is essentially the same as in FIG. 5. The sealing ring 23 seals off the working piston AK and the tube R' against each other.

Figure 12:
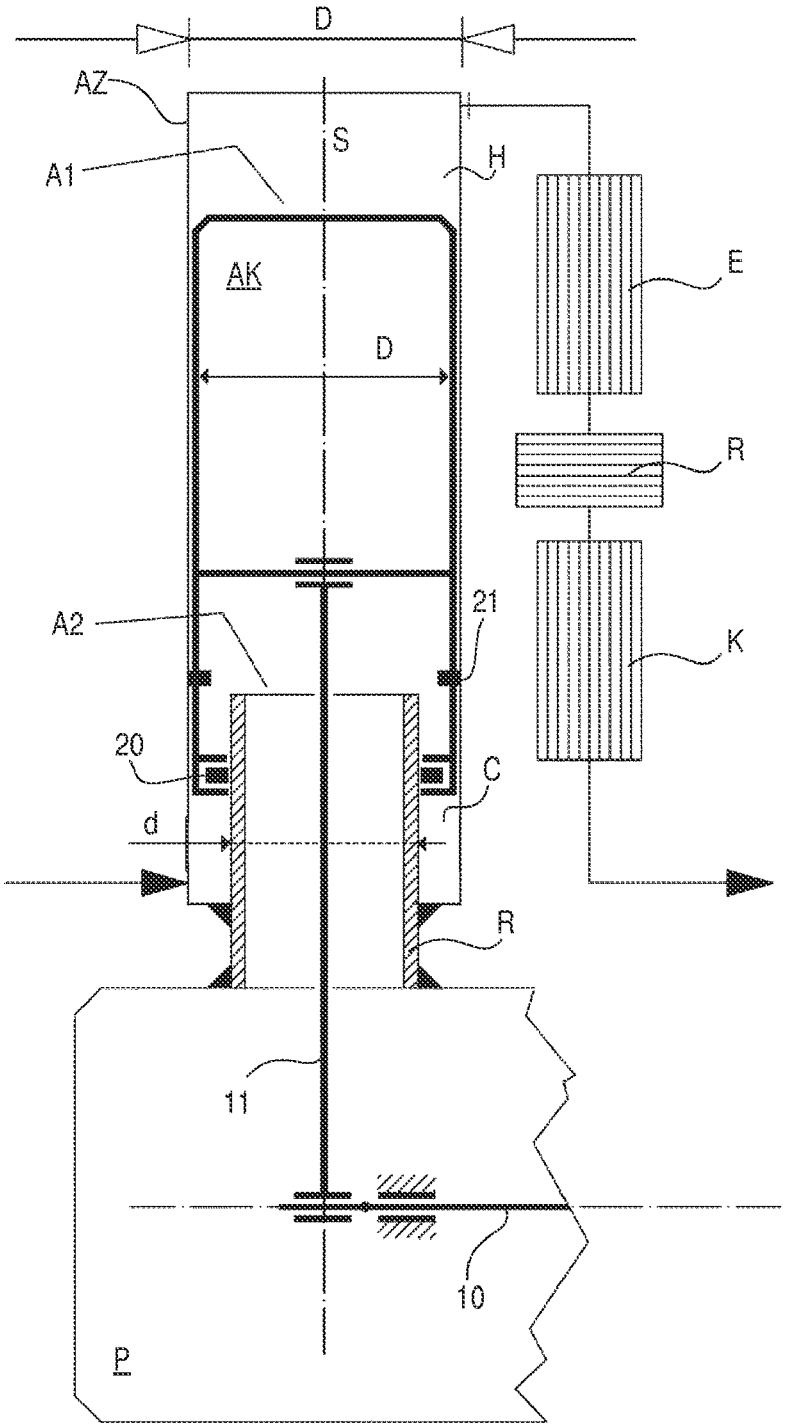
FIG. 12 shows an embodiment of a piston-cylinder unit of a Stirling engine of the double-acting Alpha type (similar to that of FIG. 4) with a working piston that is implemented as a differential piston arranged between a tube extending into the cylinder and the inner wall of the cylinder.

The example of FIG. 12 is a modification of the example of FIG. 4, whereby the step piston of FIG. 4 has been replaced here by a differential piston. The working cylinder AZ and the working piston AK (differential piston) are essentially designed just like the displacer piston VK and the displacer cylinder of FIG. 11 and therefore reference is made to the corresponding descriptions above. As already explained with regard to FIG. 4, numerous (e.g. four) cylinder units can be connected to form a double-acting Stirling machine of the Alpha type.

Figure 13:
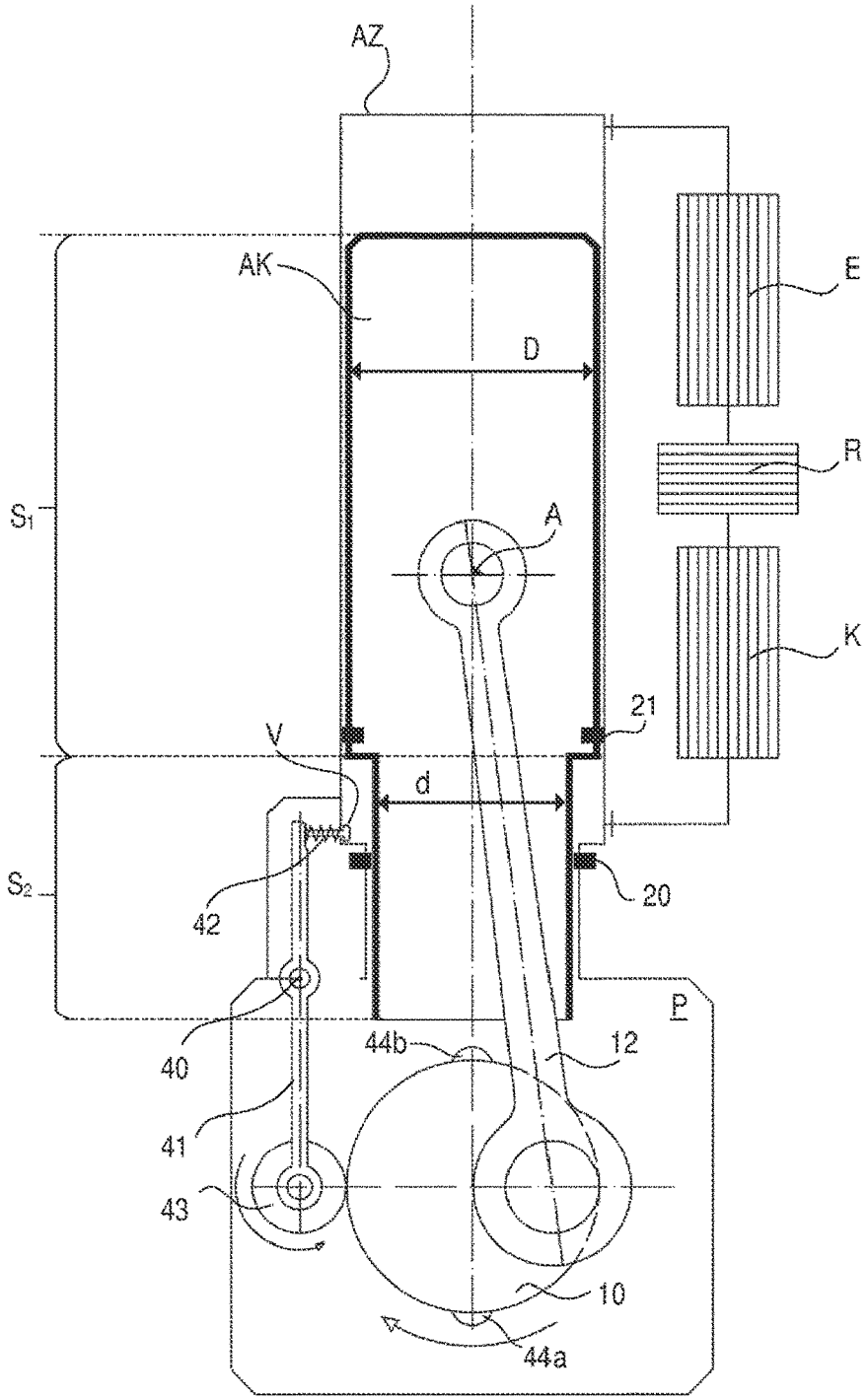
FIG. 13 shows an example of a Manson engine with a step piston in accordance with the embodiments described here.

FIG. 13 shows an example of a hot air engine that has become known by the name of Manson engine. Since the working gas in this engine does not circulate in a closed circulation (instead of which there is a connection via a valve to a buffer chamber or to the atmosphere), strictly speaking, this illustrated Manson engine is not a Stirling engine. The step piston functions both as a displacer piston and as a working piston and is designated AK in the present example. At the top and bottom dead center of the piston movement a valve is opened for a short period of time, for example, by means of a mechanical valve control, the valve connecting the ring-shaped cylinder chamber (between the narrower section of the step piston and the inner wall of the cylinder AZ) to the surrounding pressure in the buffer chamber P. The mechanical valve control may comprise, for example, a lever 41 that is swivel-mounted around a pivoting point 40 and that is tipped by cams 44*a* and 44*b* arranged on the shaft 10. The lever 41 transmits this tipping movement to the tappet of the valve V against the reset force of a spring 42. A roller 43 can be attached to the lower end of the lever 41 which is rolled by the shaft 10. The constructions design and functioning of a Manson engine is generally known (e.g. from the publications DE 199 04 269 A1 and GB 2554458 A) and will therefore not be described here in further detail. The advantages described with regard to the other embodiments that are provided by articulatedly connecting the connecting rod 12 in the section of the step piston with the large diameter are also provided by the Manson engine.

In some Stirling engine designs the transmission chamber (cf. FIG. 14, transmission chamber G) is not used for a buffer chamber, but is operated instead under atmospheric pressure. The buffer chamber in such cases (which is under the pressure of the working gas) must be sealed off against the transmission chamber. This is achieved with a piston rod, for example, by means of special sealing elements. For this purpose, the so-called "Leningrad sealing" has proven to be reliable, in which the sealing elements are pre-tensioned with a spring. Two conically shaped discs press the sealing element against the piston rod in order to provide the sealing. Such sealing elements are well known.

Figure 14:
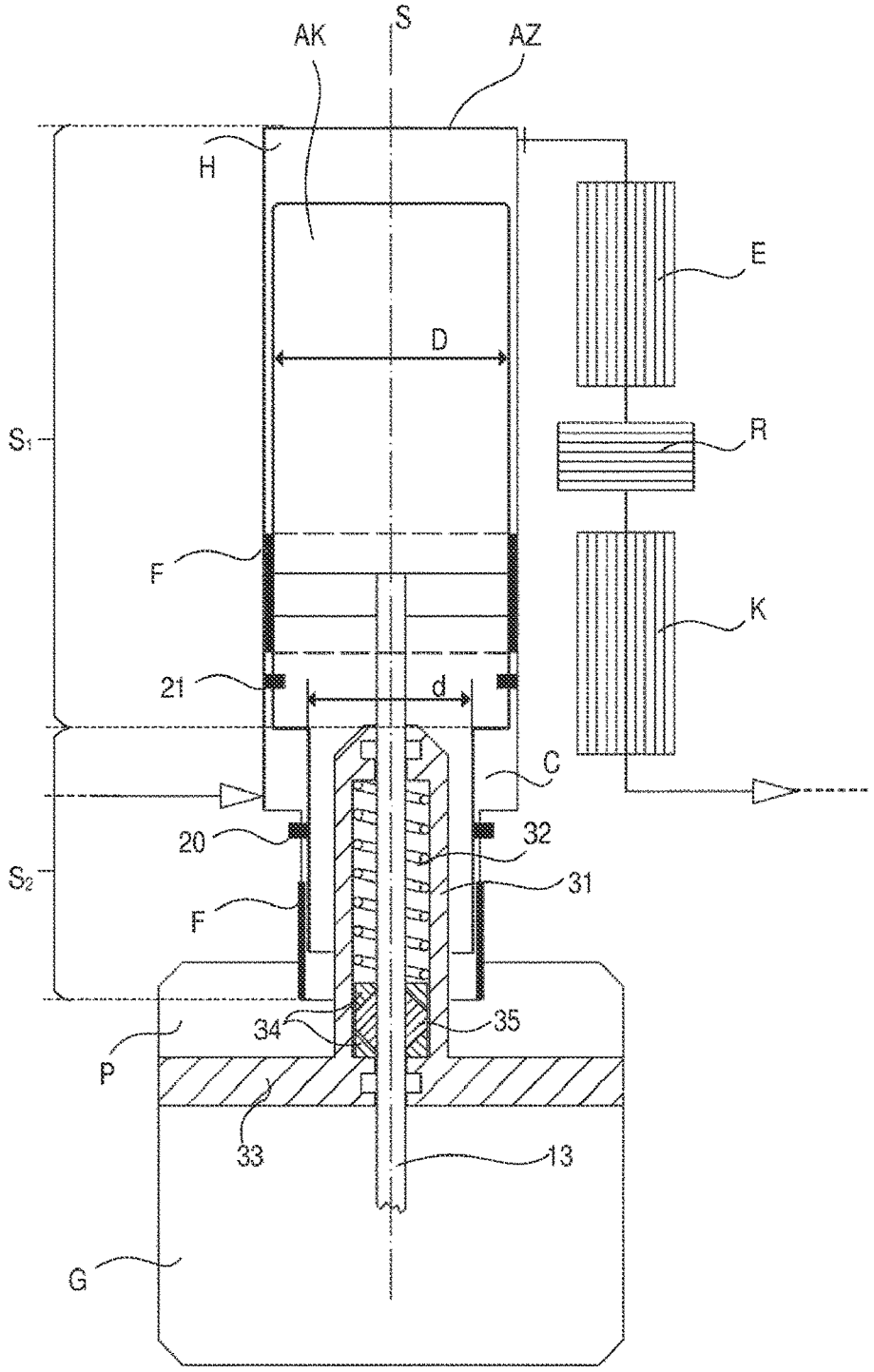
FIG. 14 shows an alternative coupling between step piston and crank drive of a Stirling engine in accordance with FIG. 4.

In FIG. 14 one such example is illustrated. FIG. 14 shows a piston-cylinder unit of a double-acting Stirling engine of the Alpha type. Numerous such piston-cylinder units (e.g. four, as in the example of FIG. 2) can be coupled to form a double-acting Alpha engine. In accordance with the example illustrated here, a double-acting step piston is provided as the working piston AK in order to reduce the height of the design. As in the previous examples, the step piston AK has a first section $S_1$ with a larger diameter D and a second section $S_2$ with a smaller diameter d, and the step piston AK is at least partially hollow (at least in the region of the second section $S_2$ with the diameter d). However, as opposed to the example of FIG. 4, the step piston AK is not directly connected to a connecting rod of a crank drive, but instead has (as in the example of FIG. 2) a piston rod 13. Further, unlike the example of FIG. 2, the guide and sealing elements of the piston rod 13 can be arranged inside of the piston shaft of the step piston that faces in the direction of the crank drive (section S2 with outer diameter d). In this embodiment, the piston rod 13 can be connected, e.g. to a crank shaft via a connecting rod in a manner similar or identical to that illustrated in the example of FIG. 2 (and with the same resulting disadvantages). It may therefore be better to couple the piston rod 13 to a Ross yoke or a swash plate mechanism, as these construction designs result in a smaller deflection of the connecting rod or do not require a connecting rod at all. Such transmissions are known, e.g. from the publications GB 2174457 A or WO 2010/093666 A2.

The second section $S_2$ of the step piston AK, which faces in the direction of the crank drive (e.g. crank shaft 10, cf. e.g. FIG. 2), ends in a buffer chamber P for the working gas of the Stirling machine. A dividing wall 33 separates the crank housing into a buffer chamber P and a transmission chamber G in which the transmission is arranged (not shown in FIG. 14, cf. FIGS. 7 and 8). The piston rod 13 connected to the step piston AK extends through an opening in the dividing wall 33. The sealing element includes a bushing 31 that is fixedly attached to the dividing wall 33 and through which the piston rod 13 extends. A ring-shaped sealing element 35 is arranged around the piston rod 13 inside of the bushing 31. The sealing element 35 is clamped between two conically formed discs 34 along the longitudinal axis S of the piston rod 13 (cylinder axis S). The tension force needed for this is provided by a spring 32 that can be arranged around the piston rod 13 on the inside of the bushing 31 (e.g. in the case of a spiral spring) and which exerts a force onto the discs 34 along the longitudinal axis S of the piston rod 13. In the examples of FIGS. 2 and 4, there is no separation of the buffer chamber P from the transmission chamber G and the crank drive is arranged in the buffer chamber. As opposed to this, the present example it is possible to separate the buffer chamber P and the transmission chamber G, allowing the transmission to operate under ambient pressure. A construction design in accordance with FIG. 2 would, theoretically, not need a buffer chamber. In the example according to FIG. 5 a separate buffer chamber P may be advantageous, as otherwise, due to its displaced volume, the lower piston section $S_2$ would generate excessively high pressure oscillations and thus exert excessively strong forces onto the housing and the dividing wall 33.

Terms such as "first", "second", and the like, are used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

It is to be understood that the features of the various embodiments described herein may be combined with each other, unless specifically noted otherwise.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A hot air engine, comprising:

a transmission with a connecting rod;

a cylinder;

a differential piston arranged in the cylinder; and a tube that extends into the cylinder, wherein one end of the differential piston is arranged between the tube and an inner wall of the cylinder, wherein the cylinder and the differential piston are configured such that a ring-shaped cylinder chamber is formed between the tube and the inner wall of the cylinder, wherein the differential piston is at least partially hollow, wherein the connecting rod is mounted on an inside of the differential piston such that the ring-shaped cylinder chamber extends around the connecting rod, wherein a first sealing ring is arranged between the tube and an inner wall of the differential piston.

2. The hot air engine of claim 1, wherein the connecting rod is articulatedly connected on the inside of the differential piston.

3. The hot air engine of claim 1, wherein the tube also extends into the inside of the differential piston when the differential piston is at an upper dead center position.

4. The hot air engine of claim 1, wherein the tube, the differential piston and the cylinder are arranged coaxially to each other.

5. The hot air engine of claim 1, wherein the tube is immovable relative to the cylinder.

6. The hot air engine of claim 1, wherein a second sealing ring is arranged between the differential piston and the inner wall of the cylinder, and wherein the ring-shaped cylinder chamber is sealed off from a buffer space located below the cylinder by the first sealing ring.

7. The hot air engine of claim 1, further comprising:

a further piston arranged in a further cylinder, the further piston being coupled to the transmission by a further connecting rod.

8. The hot air engine of claim 7, wherein a ring-shaped cylinder chamber is formed in each of both the cylinder and the further cylinder, and wherein the ring-shaped cylinder chamber of the cylinder and the ring-shaped cylinder chamber of the further cylinder are connected via a pipe.

9. The hot air engine of claim 1, wherein the connecting rod is articulated inside the differential piston by a slide bearing or a roller bearing or by a spherical joint bearing.

10. The hot air engine of claim 1, wherein the pipe leads into a buffer chamber for a working gas of the hot gas machine.

11. The hot air engine of claim 10, wherein the transmission is arranged in the buffer chamber.

* * * * *